United States Patent [19]

Kato et al.

[11] Patent Number: 4,473,510

[45] Date of Patent: Sep. 25, 1984

[54] CARBURETOR HAVING AIR FUEL RATIO ADJUSTING MEANS

[75] Inventors: Shinzo Kato; Nagao Nakamura, both of Tokyo, Japan

[73] Assignee: Nissan Motor Co. Ltd., Yokohama, Japan

[21] Appl. No.: 445,679

[22] Filed: Nov. 30, 1982

[30] Foreign Application Priority Data

Dec. 7, 1981 [JP] Japan ..... 56-196665

[51] Int. Cl.[3] ..... F02M 7/24

[52] U.S. Cl. ..... 261/39 A; 261/121 B

[58] Field of Search ..... 261/39 A, 121 B, 121 A

[56] References Cited

U.S. PATENT DOCUMENTS 4,129,622 12/1978 Tamazawa et al. ..... 261/121 B

FOREIGN PATENT DOCUMENTS 49-91617 4/1973 Japan .

48-70020 9/1973 Japan .

*Primary Examiner*—Tim Miles

*Attorney, Agent, or Firm*—Schwartz, Jeffery, Schwaab, Mack, Blumenthal & Koch

[57] ABSTRACT

In a carburetor system having a main fuel passage for supplying fuel from a float chamber to a main fuel discharge nozzle and an air bleed pipe inserted into the main fuel passage, there is provided an auxiliary air introduction passage for additionally supplying air so as to adjust the air fuel ratio. The auxiliary air passage comprises a primary air passage having an upstream end communicating with the atmosphere and a downstream end opening into the main fuel passage below the fuel level, and a secondary air passage which branches off from the primary air passage and opens into the main fuel passage at a predetermined height above the fuel level. The cross sectional area of the secondary air passage is smaller than that of the primary air passage.

3 Claims, 3 Drawing Figures

CARBURETOR HAVING AIR FUEL RATIO ADJUSTING MEANS

BACKGROUND OF THE INVENTION

The present invention generally relates to a carburetor system for an internal combustion engine, and more specifically to a carburetor system having means for adjusting the air fuel ratio by additionally introducing air to a main fuel system so as to compensate for altitude change or other changes of engine operating conditions.

In such a carburetor system, there is formed an auxiliary air introduction passage for additionally supplying air to a main fuel system and a valve device for controlling the air flow through the auxiliary air passage in accordance with atmospheric pressure, ambient air temperature or other variables. An upstream end of the auxiliary air passage communicates with the atmosphere and its downstream end opens into a main fuel passage at a portion where an air bleed pipe is inserted. The downstream end of the auxillary air passage is positioned below a fuel level, so that a fuel normally fills a portion of the auxiliary air passage adjacent to the downstream end to the fuel level. In some cases, fuel is sucked into the auxiliary air passage beyond the fuel level because of a pressure difference between the main fuel system and the auxiliary air passage. Occasionally, fuel contained in the auxiliary air passage is abruptly forced out into the main fuel system under the influence of rapidly changing engine operating conditions. This fuel is supplied to the engine and causes an abrupt enrichment of the air fuel mixture, unfavorably affecting engine drivability and emission control.

SUMMARY OF THE INVENTION

It is an object of the present invention to provide a carburetor system having an auxiliary air introduction passage which is arranged to prevent undesirable influences of a fuel contained therein.

According to the present invention, the carburetor system comprises an intake air passage leading to an intake port of the engine and having a venturi portion, a float chamber containing fuel maintained at a predetermined fuel level, main fuel supplying means comprising a main fuel discharge nozzle centered in the venturi portion of the intake air passage and a main fuel passage leading from the float chamber to the main nozzle, and air bleed means comprising an air bleed pipe inserted into the main fuel passage. The carburetor system of the present invention further comprises auxiliary air introduction passage means for introducing air from the outside to the main fuel passage, and valve means. The auxiliary air introduction passage means comprises a primary air passage having an upstream end communicating with the outside and a downstream end opening into the main fuel passage below the fuel level, and a secondary air passage which branches off from the primary air passage at an intermediate position between the upstream end and the downstream end and opens into the main fuel passage at a predetermined height above the fuel level. The secondary air passage has a cross sectional area similar than that of the primary air passage. The valve means is connected with the upstream end of the primary air passage for regulating an air flow introduced into the primary air passage.

DETAILED DESCRIPTION OF THE INVENTION

Figure 1:
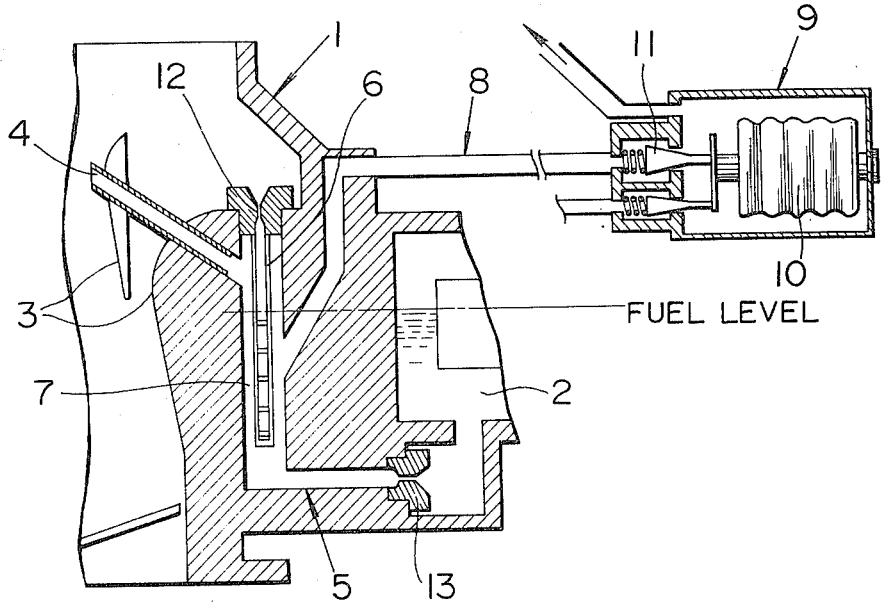
FIG.1 PRIOR ART
FIG. 1 is a schematic sectional view of a conventional arrangement.

FIG. 1 shows a conventional carburetor system having an auxiliary air introduction passage for additionally supplying air to a main system to adjust the air fuel ratio. This system is basically the same as a system shown in FIG. 1 of Japanese utility model unexamined provisional publication No. 91617/1974. In this example, the auxiliary air introduction passage is utilized for altitude compensation.

In FIG. 1, a carburetor body 1 has a float chamber 2 and a venturi portion 3. A main nozzle 4 opening into the venturi portion 3 is connected with the float chamber 2 through a main fuel passage 5. An air bleed pipe 6 is inserted into the main fuel passage 5 to form a mixing chamber 7. One end of an auxiliary air introduction passage 8 opens into the mixing chamber 7 of the main fuel passage 5 at a level below a fuel level. The other end of the auxiliary air introduction passage 8 is connected with a clean side outlet of an air cleaner (not shown).

There is provided, in the auxiliary air introduction passage 8, a bellows operated valve device 9 for controlling an air flow through the auxiliary air introduction passage 8. A bellows 10 of the valve device 9 contracts and expands in accordance with atmospheric pressure change due to altitude change. A needle valve 11 is linked with one of the bellows and arranged to increase and decrease the cross sectional area of the auxiliary air introduction passage in response to the movement of the end of the bellows. A main fuel jet 13 is disposed at the entrance of the main fuel passage for metering fuel supplied from the float chamber 2.

When an automobile is driven at or near sea level, receiving a relatively high atmospheric pressure, the bellows 10 contracts, and the needle valve 11 closes the auxiliary air introduction passage 8 and shuts off air supply therethrough. A negative pressure within the main fuel system draws air into the mixing chamber 7 only from a main air jet 12 through the air bleed pipe 6. The main air jet 12 is designed to control air flow therethrough, so that air and fuel are mixed at a proper mixture ratio in accordance with the density of air.

When the automobile is receiving a relatively low atmospheric pressure at high elevations, the auxiliary air introduction passage 8 is opened by the expansion of the bellows 10, and supplies air into the mixing chamber 7 in addition to the air supply from the main air jet 12. At high elevations, the air density is low and so the resulting air fuel mixture tends to become too rich. The auxiliary air passage 8 compensates for this and maintains a proper air fuel ratio by supplying additional air. Thus, the carburetor system of FIG. 1 is arranged to adjust the air fuel ratio by controlling the additional air quantity in accordance with the atmospheric pressure change.

In this conventional carburetor system, the auxiliary air passage 8 opens into the mixing chamber 7 only at a single position below the fuel level. This causes problems as follows. When a negative pressure is greater in the a xiliary air passage 8 than in the main fuel system during deceleration at high elevations or under other operating conditions, fuel is sucked into the auxiliary air passage. This fuel sucked into the auxiliary passage by the pressure difference is forced back to the main fuel system and supplied to the engine when the pressure difference is reversed by a change from deceleration to acceleration, for example. This causes a sudden change of the air fuel ratio toward the rich side, and unfavorably affects drivability and emission control.

When additional air starts to flow through the auxiliary air passage 8 due to an altitude change from low to high, fuel in the auxiliary air passage 8 below the fuel level is pushed out into the main fuel system instantaneously by the additional air flow. In this case, too, abnormally rich mixture is supplied to the engine and exerts a harmful influence on engine drivability and emission control.

These problems are solved if the auxiliary air passage 8 is arranged to open into the mixing chamber 7 above the fuel level, as shown in Japanese utility model unexamined provisional publications No. 70020/1973 and No. 91617/1974. In this case, however, the additional air can not help break the fuel into a sudsy air/fuel emulsion.

Figure 2:
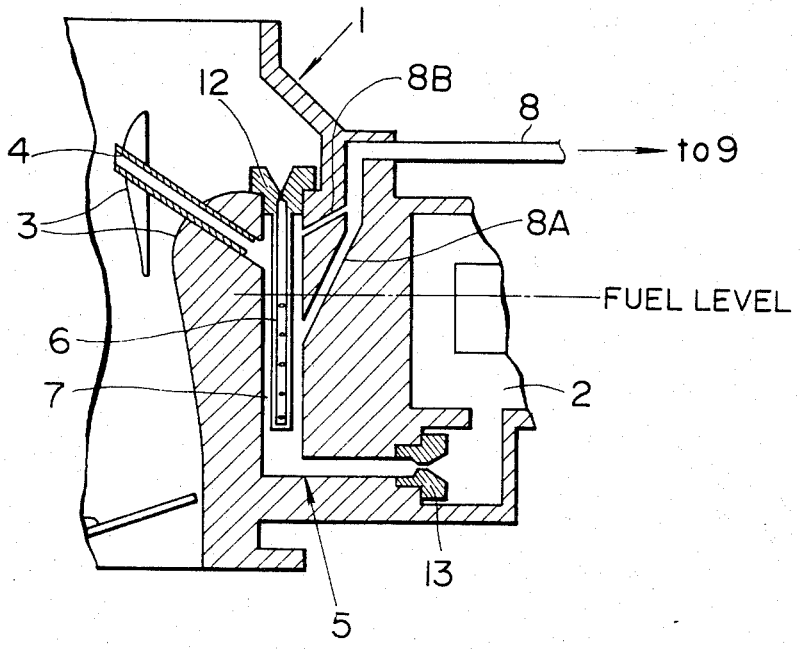
FIG. 2 is a schematic sectional view showing a main portion of the carburetor arrangement according to the present invention.

In view of the above mentioned description, reference is now made to FIG. 2, wherein an embodiment of the present invention is shown.

In the carburetor system shown in FIG. 2, there is formed an auxiliary air introduction passage 8 composed of a primary air passage 8A and a secondary air passage 8B. The primary air passage 8A has one end opening into a mixing chamber 7 below the fuel level and the other end connected to a clean side of an air cleaner (not shown) through a bellows operated valve device 9 as shown in FIG. 1. The secondary air passage 8B branches off from the primary air passage 8A and opens into the mixing chamber 7 at a high position above the fuel level.

The secondary air passage 8B has a passage opening size smaller than that of the primary air passage 8A. The secondary air passage 8B serves to maintain pressures equal between the main fuel system and the primary air passge 8A of the auxiliary air introduction passage 8. The primary air passage 8A has such an opening size that a sufficient amount of an additional air is introduced into the mixing chamber 7.

In other respects, the construction of FIG. 2 is the same as the construction of FIG. 1.

Figure 3:
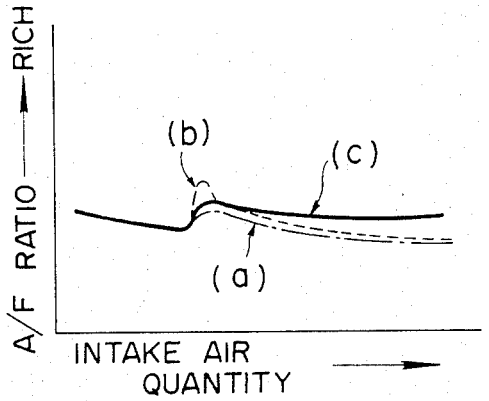
FIG. 3 is a diagram showing air fuel ratio characteristic curves.

In this embodiment, the secondary air passage 8B instantaneously eliminates a pressure difference between the main fuel system and the auxiliary air introduction passage 8, so that a fuel is not sucked into the primary air passage 8A even during deceleration at high elevations where a negative pressure in the auxiliary air introduction passage 8 tends to become greater than a negative pressure in the main fuel system. Thus, the arrangement of this embodiment can prevent the air fuel mixture from becoming abruptly rich at a transition from deceleration to acceleration, as shown by a air fuel ratio characteristic curve (a) in FIG. 3. In FIG. 3, a curve (b) shows a characteristic in a conventional design, and a curve (c) shows a characteristic at low elevations.

When the auxiliary air introduction passage 8 is opened and additional air starts to flow therethrough, a small amount of the additional air is allowed to flow through the secondary air passage 8B. Accordingly, the secondary air passage 8B serves to prevent a sudden increase of fuel supply caused by the additional air flow suddenly pushing fuel in the primary air passage 8A out into the main fuel system.

In this arrangement, the opening size of the secondary air passage 8B is so small that most of the additional air flows through the primary air passage 8A. Accordingly, the additional air is sufficiently utilized to break the fuel into fine droplets.

There is no air flow through the primary air passage 8A and the secondary air passage 8B when the valve device closes the auxiliary air passage 8 at low elevations, so that the carburetor system can act in a normal manner. The secondary air passage of the present invention can be readily formed without a substantial cost increase.

What is claimed is:

1. A carburetor system for an internal combustion engine, comprising:

an intake air passage leading to an intake port of the engine and having a venturi portion, a float chamber containing fuel maintained at a predetermined fuel level, main fuel supplying means comprising a main fuel discharge nozzle centered in the venturi portion and a main fuel passage leading from said float chamber to said main nozzle, air bleed means comprising an air bleed pipe inserted into said main fuel passage, auxiliary air introduction passage means for introducing air from the outside to said main fuel passage, said auxiliary air introduction passage means comprising a primary air passage having an upstream end communicating with the outside and a downstream end opening into said main fuel passage below a fuel level in said main fuel passage and a secondary air passage which branches off from said primary air passage at an intermediate position between the upstream end and the downstream end and opens into said main fuel passage at a predetermined height above the fuel level, said secondary air passage having a cross sectional area smaller than that of said primary air passage, and valve means connected with the upstream end of said primary air passage for regulating an air flow introduced into said primary air passage.

2. A carburetor system according to claim 1, wherein said valve means is arranged to close said primary air passage above a predetermined atmospheric pressure while holding it open below said predetermined atmospheric pressure.

3. A carburetor system according to claim 1, wherein said secondary passage is smaller than said primary passage and is sized to maintain pressure in said primary passage equal to pressure in said main fuel passage.

* * * * *